US011517956B2

(12) United States Patent
Whincup et al.

(10) Patent No.: US 11,517,956 B2
(45) Date of Patent: Dec. 6, 2022

(54) BOTTLE, CAP AND MACHINE

(71) Applicant: FORDS PACKAGING SYSTEMS LIMITED, Bedford (GB)

(72) Inventors: Laura Anne Whincup, Bedford (GB); Sefton Whitlock, Bedford (GB)

(73) Assignee: FORDS PACKAGING SYSTEMS LIMITED, Bedford (GB)

( * ) Notice: Subject to any disclaimer, the term of this patent is extended or adjusted under 35 U.S.C. 154(b) by 40 days.

(21) Appl. No.: 16/813,999

(22) Filed: Mar. 10, 2020

(65) Prior Publication Data

US 2021/0283676 A1 Sep. 16, 2021

(51) Int. Cl.

| | |
|---|---|
| ***B21D 51/44*** | (2006.01) |
| ***B65D 41/02*** | (2006.01) |
| ***B21D 45/02*** | (2006.01) |

(52) U.S. Cl.

CPC ..... *B21D 51/443* (2013.01); *B21D 45/02* (2013.01); *B65D 41/02* (2013.01)

(58) Field of Classification Search

CPC ..... B21D 45/02; B21D 45/04; B21D 45/10; B21D 45/06; B21D 45/08; B21D 51/44; B21D 51/443; B21D 51/46; B21D 22/06; B21D 22/08

See application file for complete search history.

(56) References Cited

U.S. PATENT DOCUMENTS

| | | | | | |
|---|---|---|---|---|---|
| 3,771,344 | A * | 11/1973 | Wright | B21D 45/02 | 72/345 |
| 3,911,719 | A * | 10/1975 | Degenhardt | B21D 45/04 | 72/345 |
| 4,587,825 | A * | 5/1986 | Bulso, Jr. | B21D 51/44 | 413/56 |
| 6,067,830 | A * | 5/2000 | Klages | B21D 26/035 | 29/421.1 |
| 2002/0152783 | A1* | 10/2002 | Kleber | B21D 26/055 | 72/60 |
| 2012/0067102 | A1* | 3/2012 | Stodd | B21D 22/24 | 72/351 |
| 2015/0306654 | A1* | 10/2015 | Breen | B21D 45/006 | 72/427 |

FOREIGN PATENT DOCUMENTS

| | | | | |
|---|---|---|---|---|
| EP | 0803302 | * | 10/1997 | B21D 43/18 |
| GB | 300688 | A | 11/1928 | |

(Continued)

OTHER PUBLICATIONS

Teshima, Translation of WO-2014162350-A1 (Year: 2014).*

(Continued)

*Primary Examiner* — Jessica Cahill
*Assistant Examiner* — Bobby Yeonjin Kim
(74) *Attorney, Agent, or Firm* — Marshall, Gerstein & Borun LLP

(57) ABSTRACT

A machine for manufacturing a closure that has: a workspace for receiving a blank, a rim punch arranged to engage a blank received within the workspace, a center punch arranged radially inside the rim punch, the center punch arranged to engage the blank received within the workspace to form a closure, and an ejection pin arranged to cause the center punch to move such that the closure disengages from the rim punch.

10 Claims, 11 Drawing Sheets

(56) References Cited

FOREIGN PATENT DOCUMENTS

| | | | | |
|---|---|---|---|---|
| JP | S4924386 | B1 | 6/1974 | |
| JP | S51148589 | A | 12/1976 | |
| WO | WO-2014162350 | A1 * | 10/2014 | ..... B21D 22/02 |

OTHER PUBLICATIONS

Horst Translation of EP 0803302 (Year: 1997).*
European Patent Application No. 20162240.4, Extended European Search Report, dated Sep. 8, 2020.
Qureshi, Exclusive: Danone to launch compact Evian Drop bottle, Packaging News (downloaded from the Internet at:<https://www.packagingnews.co.uk/news/markets/danone-to-launch-compact-evian-drop-bottle-18-06-2014>), Jun. 18, 2014.
Design U.S. Appl. No. 29/701,060, Bottle, Whincup et al., filed Aug. 8, 2019.
Design U.S. Appl. No. 29/701,063, Bottle, Whincup et al., filed Aug. 8, 2019.

* cited by examiner

BOTTLE, CAP AND MACHINE

FIELD OF THE INVENTION

The present invention relates to a bottle, a foil cap, a method and machine for manufacturing a foil cap, a method and machine for sealing a foil cap onto a bottle, and a sealed bottle.

BACKGROUND OF THE INVENTION

Plastic bottles are known for containing fluids for drinking. Known bottles are formed of plastic, with a plastic cap screwed onto the bottle. Other bottles are known, which are glass bottles with foil caps.

Consequently, known bottles are costly to manufacture in terms of both materials and energy required.

SUMMARY OF THE INVENTION

According to a first aspect of the invention, there is provided a container sealing machine comprising: a rotary turret having a plurality of sealing heads arranged to rotate about an axis of the rotary turret, each sealing head comprising: an inductive heater arranged to inductively heat a foil closure of a container, and a sealing surface arranged to exert pressure on the closure, and a plurality of gripper assemblies arranged to rotate about the axis of the rotary turret, each gripper assembly being arranged for engaging a neck of a container. With such an arrangement, the inductive heaters may move accurately with the containers to be sealed and thus the machine may provide more accurate sealing.

Each gripper assembly may comprise two arms. This may allow the containers to be held more securely.

The arms may be biased towards each other. This may allow the arms to extend further around the neck and thereby grip the container more securely.

The arms may not comprise a metallic material. The arms may, for example, be entirely plastic or ceramic, and there may be no metal within the arms. This may allow the arms to hold the bottle at a location closer to the inductive heater, without the arms themselves being inductively heated. This in turn may allow more secure positioning of the container relative to the inductive heater and a better accuracy of sealing. It may also allow a container with a shorter neck to be sealed, thereby saving material.

Each sealing head may be aligned with a respective gripper assembly along a sealing head axis perpendicular to a respective sealing surface and may move at the same angular speed as the gripper assembly.

The machine may be arranged so that the container is supported only by the grippers during the sealing process.

Each sealing head and/or each gripper assembly may be movable along an axis perpendicular to the sealing surface. This may allow a pressure to be exerted on a closure to be sealed to the container while the closure is inductively heated.

A minimum distance between one of the inductive heaters and auxiliary aligned respective gripper assembly may be less than 3 cm. This may be the closest that a gripper and a sealing head is arranged to be in arrangements where the gripper assembly and sealing head are relatively movable. This may allow more accurate and more efficient heating of the closure as the inductive heater may be closer to the foil closure.

The gripper assemblies may be arranged to engage the container neck around more than 180° of the circumference of the container neck, optionally at least 200°. This may allow more secure gripping of the container neck.

According to a second aspect of the invention, there is provided a method of sealing a container comprising: holding a container by a gripper assembly of a rotary turret, the gripper assembly having two arms, moving the container with the rotary turret, applying a closure to the container, and inductively heating the closure with a sealing head, the sealing head moving with the container. Such a method may provide more accurate sealing of a closure onto a container.

The method may further comprise pressing the sealing head onto the closure. This may improve the strength of the seal formed.

The method of the second aspect may be carried out by the machine of the first aspect.

A third aspect of the invention provides a machine for manufacturing a closure, comprising: a workspace for receiving a blank, a rim punch arranged to engage a blank received within the workspace, a center punch arranged radially inside the rim punch, the center punch arranged to engage the blank received within the workspace to form a closure, and an ejection pin arranged to cause the center punch to move such that the closure disengages from the rim punch.

With such an arrangement, there is provided a machine operable to manufacture a closure having a wider recess portion on a top surface.

The center punch may be movable relative to the rim punch.

The rim punch may be arranged to move a longer distance than the center punch. This may allow the rim punch to retract from the workspace further than the center punch so that the closure may be engaged only with the center punch.

The ejection pin may engage the center punch at a first end of the ejection pin and the machine may further comprise an ejection plate arranged to engage the ejection pin at a second end of the ejection pin opposite the first end. This may provide a simple means for differentiating the movement of the center punch and the rim punch, so that the closure disengages from the rim punch.

The rim punch and the center punch may be arranged to move in a first direction towards the workspace in order to engage the closure.

The ejection pin may exert a force on the center punch in the first direction.

The ejection pin may limit movement of the center punch in a second direction away from the workspace. This may disengage the closure from the rim punch, as the rim punch may move further from the workspace.

The machine may further comprise a fluid jet, optionally a gas jet, arranged to disengage a closure from the center punch. This may provide a simple means for expelling a formed closure from the machine.

According to a fourth aspect of the invention, there is provided a system for manufacturing a closure, comprising a machine according to the third aspect wherein the machine according to the third aspect is a first machine, and wherein the system further comprises a further machine substantially similar to the first machine.

The ejection pins of the respective machines may have different lengths. This may allow the machines each to disengage their respective formed closures from their respective rim punctures at different times.

In an alternative aspect, substantially similar to the fourth aspect, wherein the machines each further comprise an ejection plate, the ejection plate of the first and further machines each have respective faces for engaging the respective ejection pins, and the respective faces are spaced in a direction along which the rim punch and/or center punch are arranged to move. This may provide an alternative means for staggering the time at which formed closures disengage from respective rim punctures.

The system may further comprise a plurality of fluid jets, each fluid jet being directed toward a different workspace. This may allow improved sequential expulsion of multiple closures from the system.

According to a fifth aspect of the invention, there is provided a method of manufacturing a closure comprising: engaging a blank with a tool such that the blank is deformed by the tool to form a closure, partially disengaging the closure from the tool, such that the cap engages only a central portion of the tool, and disengaging the closure from the central portion of the tool. With such a method, a closure may be formed having a wider recess in a flat surface thereof.

The method according to the fifth aspect may be carried out by the machine according to the third aspect or the system according to the fourth aspect.

According to a sixth aspect of the invention, there is provided a foil closure for a container comprising: a top surface having an annular portion lying in a first plane and recessed portion lying in a second plane, the second plane being parallel to and spaced from the first plane, and a sidewall extending away from the top surface in a direction substantially normal to the first and second planes, wherein the recessed portion has a diameter $d_r$ and the side wall has an outer diameter $d_a$, and, wherein $d_r > d_a - 8.3$ mm. Such a foil closure may have a high strength and a secure sealing to a bottle, without creating ripples on a sealing area of the closure during sealing.

The second plane may be spaced from the first plane by 1 mm or less. This may provide a strong closure.

The sidewall may meet the top at a fillet having a radius of at least 0.1 mm. This may allow the closure to be placed more accurately onto a curved rim of a container.

The sidewall may extend at least 2 mm from the top. This may allow a strong connection between the container and the closure and may reduce contamination of the rim of the container.

The closure may further comprise a pull tab extending from the sidewall. This may provide an easy means of opening the sealed container for a consumer.

According to a seventh aspect of the invention, there is provided A plastic container comprising: a container body for holding a liquid, and a neck extending from the body along an axis, the neck comprising: a rim, the rim defining a container opening, which is in fluid communication with the body, the opening having a diameter $d_o$, wherein a cross-section of the rim has a perimeter, at least a portion of the perimeter has a radius of curvature $r_c$, and $0.005d_o < r_c < 0.15d_o$. With such an arrangement there is provided a plastic container which may have an improved sealing strength.

The neck may further comprise a support member axially spaced from the rim, the support member defining a radial protrusion from the neck. With such a support member, the container may be more securely held by a machine during sealing.

The rim may have a thickness $t_r$ and the neck may have a thickness $t_n$ and $t_r$ may be greater than $t_n$. This may allow a more secure sealing of a closure to the container.

The diameter of the opening may be less than 27 mm. This may provide a conveniently sized opening for a consumer to drink from the container.

The radius of curvature of a cross-section of the rim taken in a plane parallel to the axis may be at least 1 mm. This may allow a stronger seal to a closure.

The container may not have a screw thread. This may reduce the amount of material required for manufacturing the container.

The container may be transparent.

The container may be made from PET (polyethylene terephthalate). This may allow the container to be recycled.

According to an eighth aspect of the invention there is provided a preform which is blow-mouldable to form a container according to the seventh aspect of the invention.

The preform may have a preform body blow-mouldable for forming the container body, the preform body having an outer diameter not greater than the outer diameter of the neck.

According to a ninth aspect of the invention, there is provided a sealed plastic container comprising: a plastic container having a rim defining a container opening, and a foil closure adhered to the rim over an annular adhesive area, a portion of the foil closure covering the opening, wherein, when an internal pressure in the container is greater than an external pressure, the portion of the foil closure is arranged to take a domed shape, and wherein the plastic container is arranged such that, when the portion of the foil closure takes said domed shape, the portion of the foil closure meets the rim at a tangent to the rim at a radially inner edge of the adhesive area.

With such an arrangement, any adhesive seal between the closure and container may have only sheer forces imparted on it by an internal pressure and not tensile forces and may therefore provide strong resistance to failure due to high internal pressure (e.g. caused by squeezing of the container) but may be readily separable by peeling of the closure by a consumer, which may impart a tensile force to the adhesive.

The sealed plastic container according to the ninth aspect may comprise the plastic container according to the seventh aspect and/or the foil closure according to the sixth aspect.

BRIEF DESCRIPTION OF THE DRAWINGS

Various aspects of the invention will now be described, by way of example only, with reference to the accompanying drawings, in which.

Figure 15:
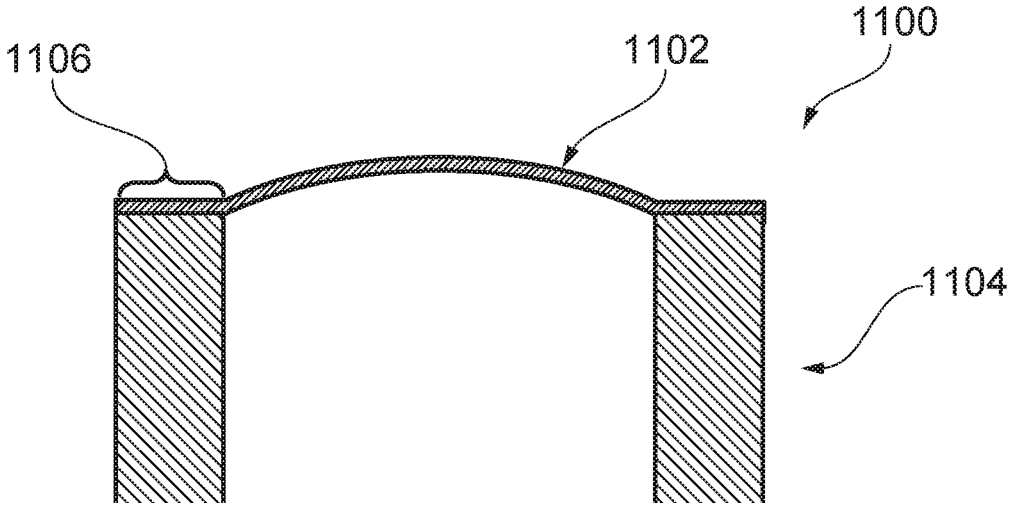

and;

FIG. 15 shows a cross-section of a neck of a prior-art sealed container.

DETAILED DESCRIPTION OF EMBODIMENT(S)

The present invention relates to a plastic bottle for holding drinking water or any other liquid having a lower material and energy requirement for manufacture and a good resistance to bursting due to potentially high internal pressures (e.g. those which are encountered during squeezing of a flexible container). This may be achieved by providing a closure, in the form of a foil cap, with an appropriate shape and a plastic bottle having a rim having an appropriate shape, each may be used separately and with different configurations of bottles and caps respectively and the cap and bottle combination may be further improved by using a particular sealing machine and sealing method, which may be more energetically efficient and may provide an improved sealing. The manufacture of the foil cap, due to the dimensions of the cap, may be achieved via the use of a new machine and a new method for manufacturing the cap.

Figure 1:
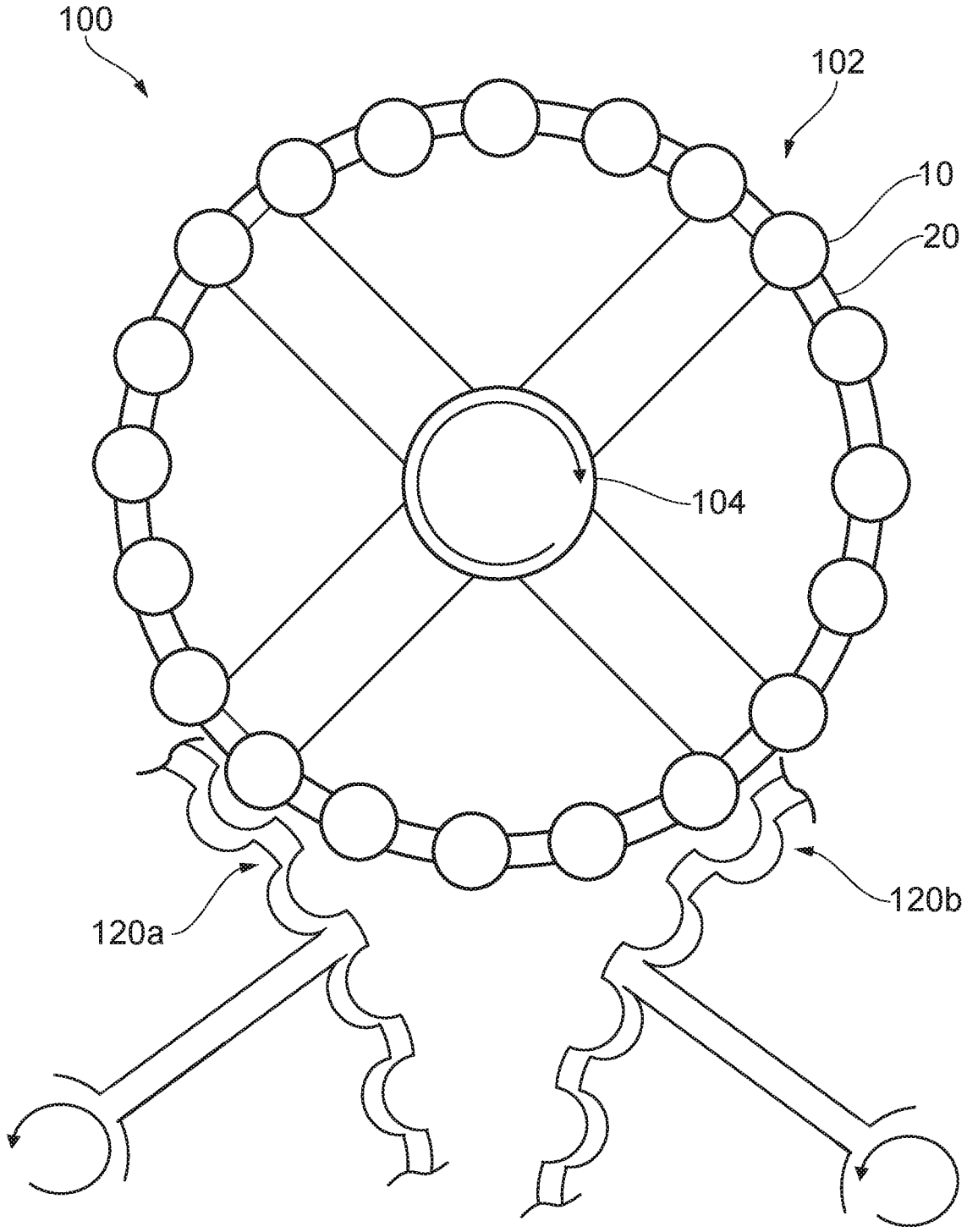
FIG. 1 shows a schematic plan view of a sealing system.

FIG. 1 shows a plan view of a sealing system 100, in which a rotary sealing turret 102 may be fed by a first star wheel 120*a*, which may carry filled, unsealed containers and sealed containers may be removed from the rotary sealing turret 102, which may also be referred to as a star-wheel, via a third star wheel 102*b*.

The unsealed containers may have closures placed on their openings while on the first star wheel 120*a*, and the placed, unsealed closures may be held in place by a sideskirt of the closure, which may surround a rim of the container. The system 100 may therefore further comprise a cap applier. The cap applier may be fed from a machine for forming closures, which is described later.

As can be seen, the rotary sealing turret 102, may comprise sealing heads 10 arranged on a circular rail 20, which may be coupled to and driven by a central driving wheel or a motor 104. Alternatively, the sealing turret 102 may be a ring arranged on bearings, and may be driven by an eccentric wheel arranged to drive an inner surface of the ring.

Figure 2:
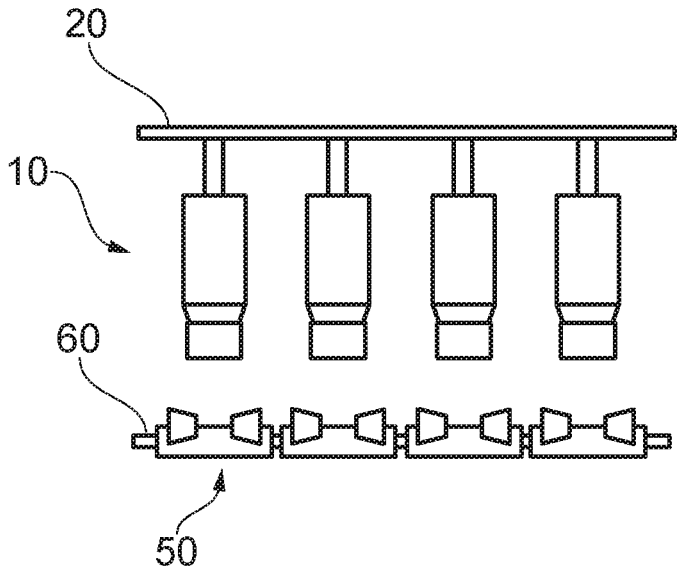
FIG. 2 shows a schematic view of a plurality of sealing heads and gripper assemblies.

FIG. 2 shows how the sealing heads 10 may be arranged on a rotary star wheel 20, for example on a circular rail 20 arranged to rotate about a central wheel 104. A plurality of gripper assemblies 50, of which there may be the same number as there are sealing heads, may be arranged to rotate at the same speed on a similar rail 60, arranged to rotate about the same central axis as the rail 20 is arranged to rotate about. Each sealing head 10 may therefore be vertically aligned with a respective gripper assembly 50 and arranged to move at the same speed as the respective gripper assembly 50.

Figure 3:
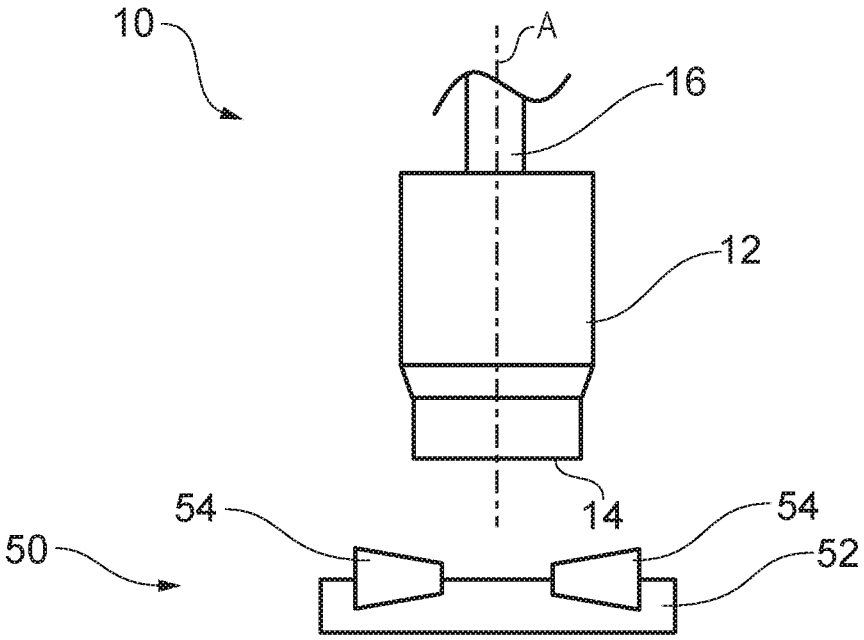
FIG. 3 shows a schematic drawing of a sealing head and gripper assembly.

FIG. 3 shows a sealing head 10 according to the present invention. The sealing head 10 comprises an inductive heater 12, which may be formed of an electric coil arranged to generate an electric field that will generate eddy currents within a nearby metallic object such as foil closure. The sealing head 10 also comprises a sealing surface 14, which may be formed of rubber, and may be arranged to press on a foil closure in order to exert a sealing pressure. The sealing surface 14 may be deformable in order to adhere the foil closure to the container evenly.

The sealing head 10 may be coupled to an actuator 16, which may be a fluid actuated cylinder, such as a hydraulic or pneumatic cylinder, or may comprise an elastic member such as a spring and the actuator 16 may be arranged to move the sealing head 10 along an axis A, which is substantially perpendicular to the sealing surface 14. The sealing head 10, the actuator 16 and the gripper assembly 50 may be arranged so that, at a lower end of the range of movement of the sealing head 10, the inductive heater 12 of the sealing head 10 is less than 3 centimeters from the grippers 50. At an upper end of the range of movement of the sealing head 10, the sealing surface 14 may be sufficiently far from the grippers 50 that it is disengaged from and does not contact a container and/or a closure held by the grippers 50.

The sealing head 10 may be controlled by a control system, which may activate the inductive heater 12 for a predetermined time and may move the actuator 16 such that the sealing surface 14 engages a closure for a predetermined time. The inductive heater 12 may be activated while the sealing surface 14 is engaged with a closure and may be deactivated while the sealing surface 14 is engaged with a closure, the sealing surface 14 continuing to exert a force on the closure after the inductive heater 12 has stopped heating the closure.

The actuator 16 may be configured to exert a force of between 30 Newtons and 200 Newtons on the closure, in order to deform the sealing surface 14 an appropriate amount and therefore provide an appropriately-sized adhesive footprint fixing a closure to a container.

Figure 4A:
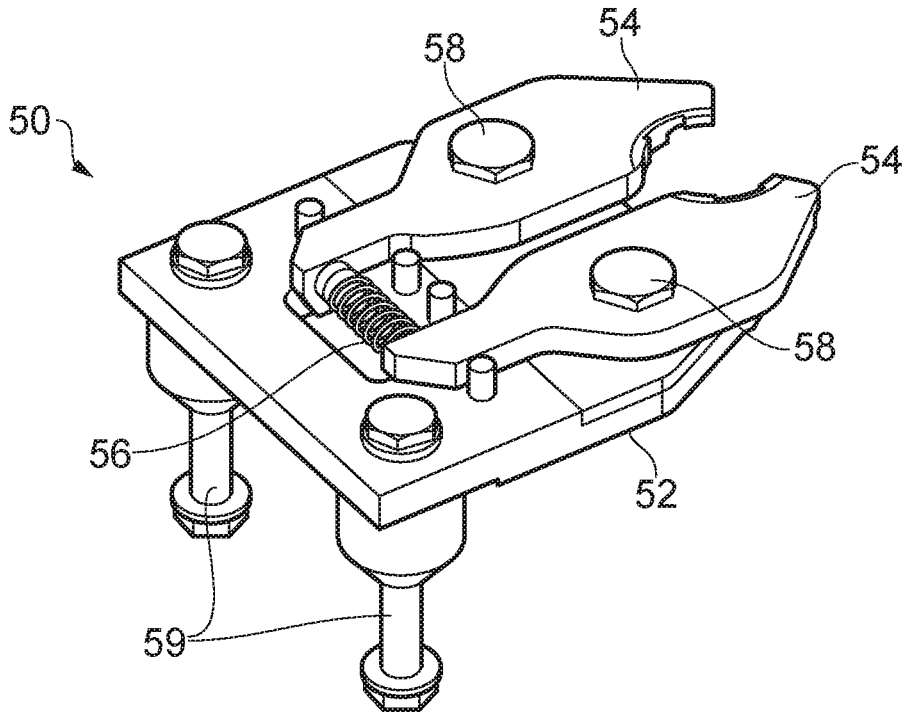
FIG. 4*a* shows a gripper assembly.

FIG. 4*a* shows a gripper assembly 50 having a base 52 and two arms 54 coupled to the base. It will be understood that the gripper assembly 50 may have more than two arms 52 and that the arms 50 of the shown embodiment are movable in a common plane but the arms 50 may be arranged to move in different planes. The arms 54 may be pivotally connected to the base 52 via bolts 58 so that each arm 52 is pivotable about a respective arm axis through a respective bolt 58. The arms 52 may be coupled by an elastic member 56, which may push two ends of the arms 54 apart, thereby biasing the opposite ends of the arms 54, arranged to receive a bottle B, together. Alternative biasing means may be used, such as electric motors, hydraulic cylinders or pneumatic cylinders. The biasing means may exert a torque on the arms 54 or may directly bias the arms 54 together.

The gripper assembly 50 may be coupled to the circular rail 60 via bolts 59 and may thereby be removably coupled. Different coupling means may also be used and the gripper assemblies 50 may be formed intrinsically with the sealing turret 102.

Figure 4B:
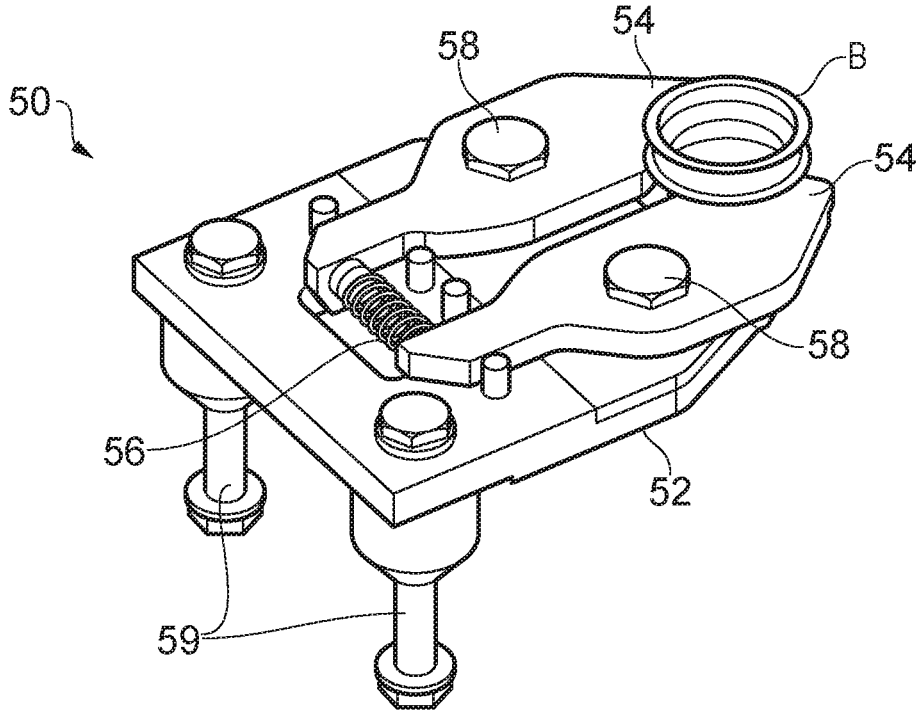
FIG. 4*b* shows a gripper assembly holding a bottle.

FIG. 4*b* shows how the neck of a bottle B may be received within the gripper arms 54 and how the gripper arms may extend around the neck of the bottle B. A contact area between the bottle B and the arms 54 may extend around greater than 180°, optionally greater than 200°, of the circumference of the neck of the bottle B. As a bottle B is pushed horizontally into the gripper arms, it may compress the spring 56 and thereby open the gripper arms 54, and the gripper arms 54 may close around the neck of the bottle B once the bottle B has moved into an appropriate position between the gripper arms 54. In order to faciliate easy entry into the arms 54 for the bottle B, the arms 54 may have an outwardly-diverging portion arranged to receive the bottle B.

The gripper arms 54 may be formed entirely of a plastic or ceramic material and may not comprise any metal so that the inductive heater 12 cannot act to heat the gripper arms 54 despite their proximity to the inductive heater 12.

The gripper arms 54 may be arranged to engage an under-side of a radial flange extending from a bottle neck. By engaging a radial flange, the gripper arms 54 alone may support the bottle. Therefore, the gripper arms 54 may have a planar surface on their upper side. The gripper arms 54 may engage the bottle neck between two flanges, which may provide support against the bottle B swinging while being held by the gripper arms 54.

Figure 5:
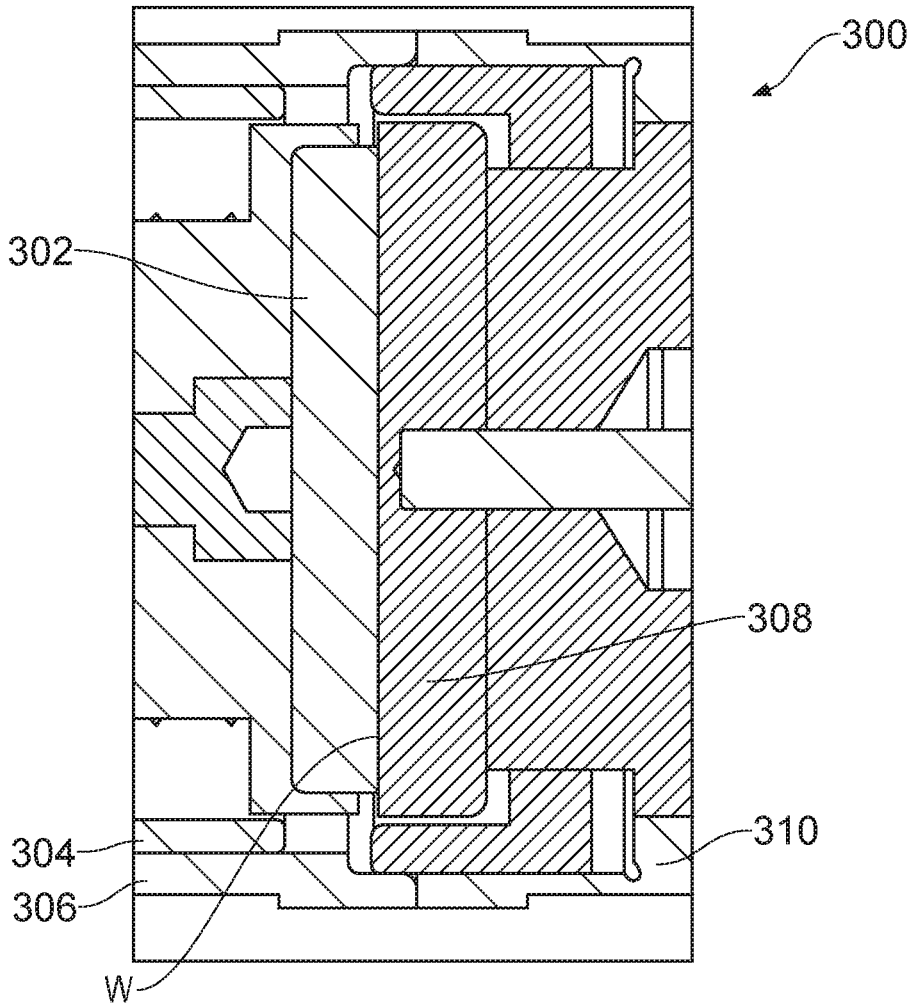
FIG. 5 shows a prior art machine for forming a closure.

FIG. 5 shows a prior art machine 300 for forming a closure. The closure may be formed by being pressed between a center punch 302 and a center counter-punch 308 and between a rim punch 306 and a rim counter punch 310. This may form a closure having a center recess and a side skirt. For disengaging the formed closure from the center punch 302 and the rim punch 306, there is provided an ejection ring 304 which may move relative to the center punch 302 and rim punch 306. However, the requirement to use an ejection ring 304 limits how the closure may be shaped. In particular, the width of a central recess in the closure may be limited by the space required by an ejection ring 304.

Therefore, alongside the realisation of the present inventors that a wider recess may improve the strength of a closure, the present inventors realised that such a closure may not be formed optimally by such a prior art machine.

Figure 6:
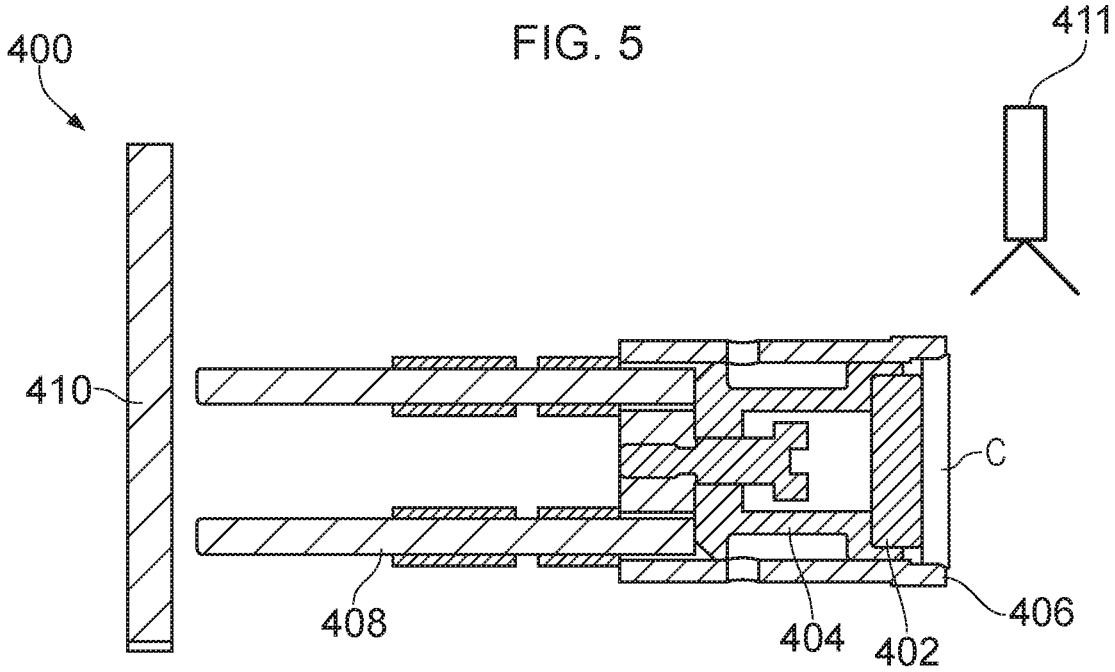
FIG. 6 shows a machine for forming a closure according to the present invention.
Figure 7:
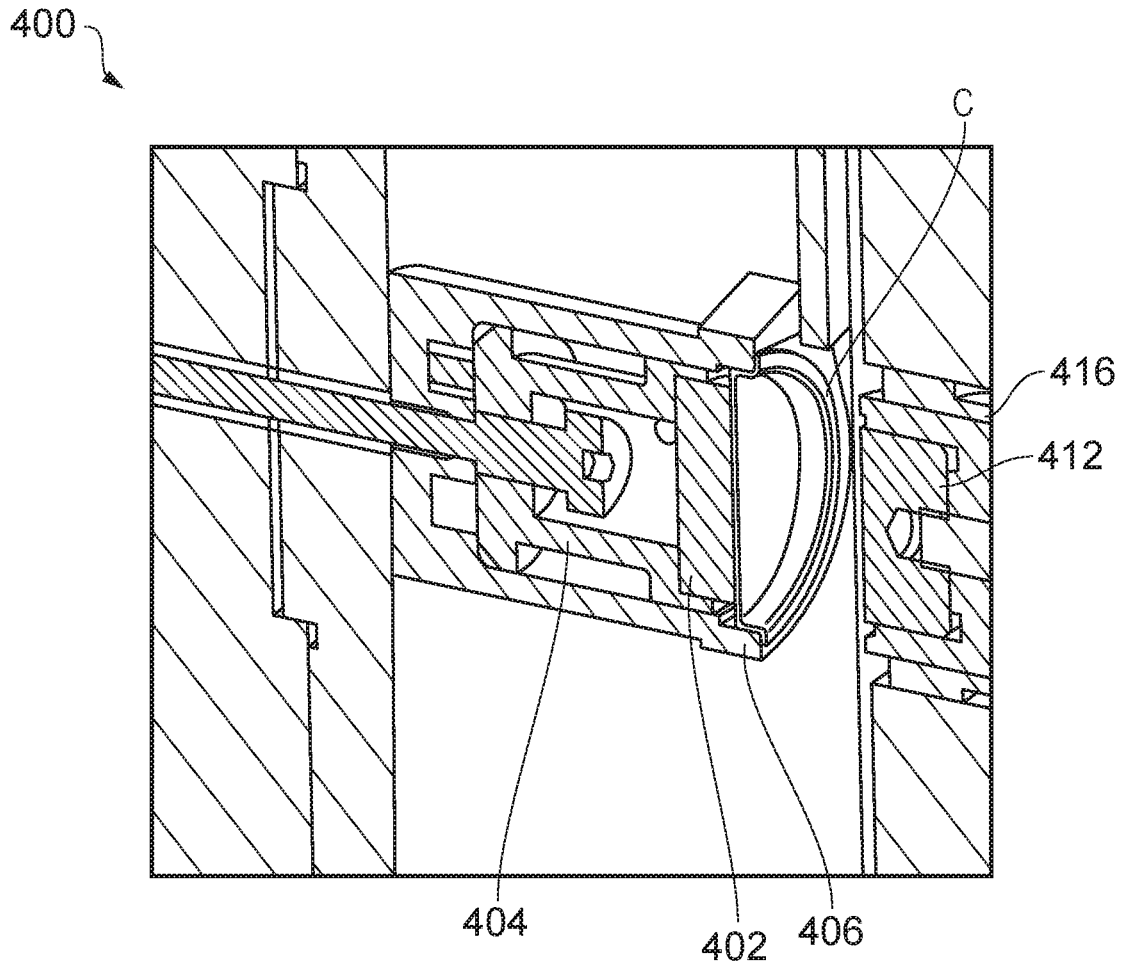
FIG. 7 shows a cross-section of a machine for forming a closure according to the present invention.

FIG. 6 shows a cross-section of a machine 400 according to the invention, and a closure C formed therein. In this machine, there is a center punch 402 and a rim punch 406, which are arranged to cooperate with a center counterpunch 412 and a rim counterpunch 416, shown in FIG. 7. The machine 400 also comprises an ejection pin 408, which is arranged to abut an ejection press 404 which in turn engages the center punch 402, so that as the center punch 402 and rim punch 406 retract, the retraction of the center punch 402 is limited, resulting in relative movement between the rim punch 406 and the center punch 402, and the closure C will thereby disengage from the rim punch 406. The force applied to the ejection pin 408 is provided by an ejection plate 410, which may be stationary, and which may be positioned appropriately to disengage the closure C from the rim punch 406 by an appropriate distance. As shown in FIG. 6, more than one ejection pin 408 may be used, so that the center punch 402 may not tilt.

In an alternative embodiment, the ejection plate 410 may be omitted and the ejection pin 408 may be fixed in position by a bolt or other fastening member, or by an electromagnet.

The machine 400 may comprise further punches and counter-punches in order to form closures having more intricate shapes. For example, the center punch 402 may be annular, with other punches arranged radially inside. The punches may also be non-planar, as opposed to being planar, so as to create corrugated closures.

There may also be one or more punches and counter-punches between the rim punch 406 and the center punch 402, those punches and counter-punches being arranged to form the closure.

A fluid jet 411, such as a gas jet, is provided for producing a jet pulse of air, or other gas for injection into a workspace of the machine 400. The gas may experience drag after its interaction with the portion of the closure C disengaged from the rim punch 406 and this drag force may peel the closure C off the center punch 402 and the fluid jet 411 may thereby expel the closure C from the machine 400.

Alternatively, the closure C may be removed from the workspace via gravity and/or disengaged from the center punch by a vibration of the center punch.

Figure 8:
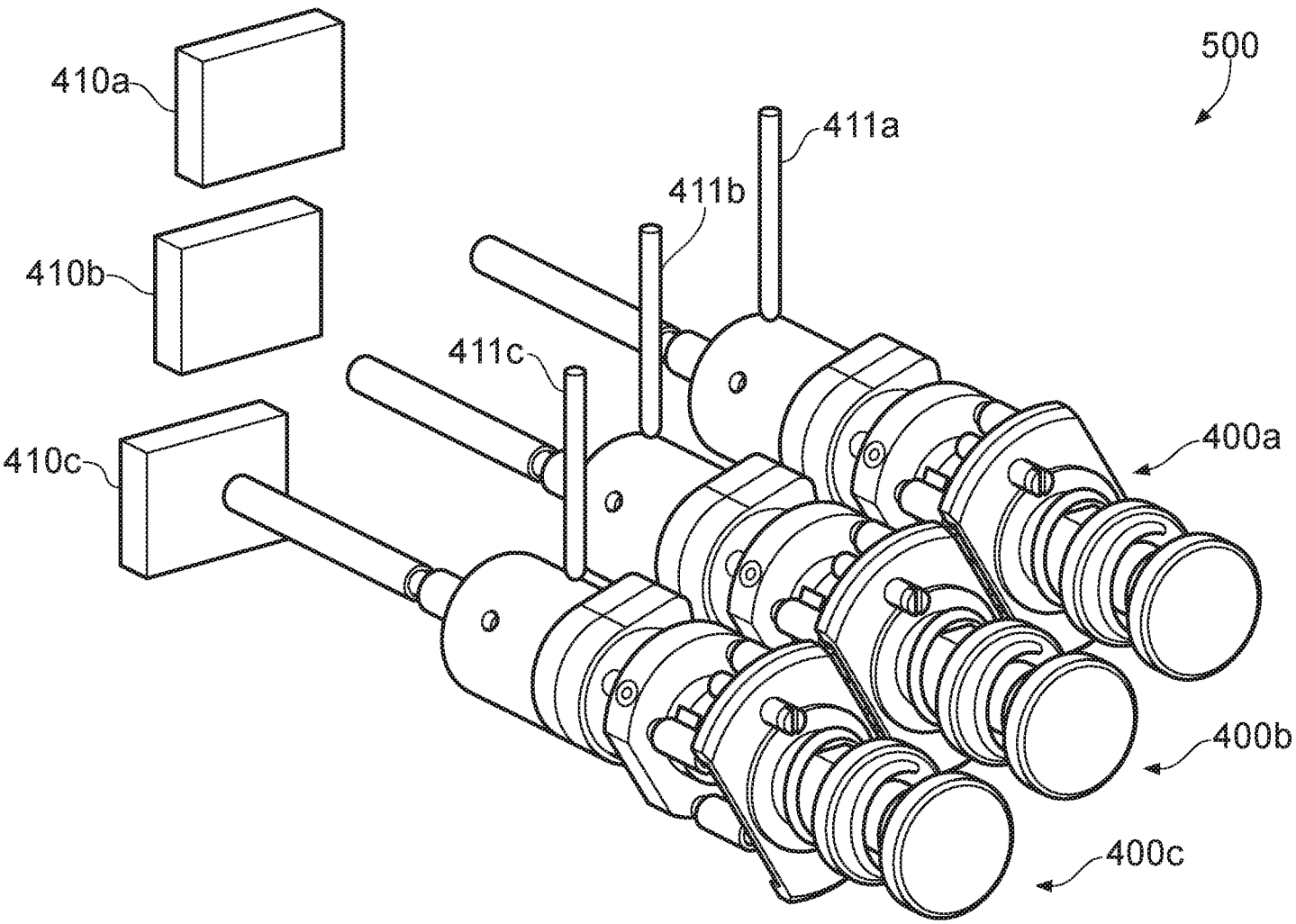
FIG. 8 shows a system for forming a closure according to the present invention.

FIG. 8 shows a system 500 comprising a plurality of machines 400*a*, 400*b*, 400*c*, each machine having a respective fluid jet 411*a*, 411*b*, 411*c* and each machine 400*a*, 400*b*, 400*c*, each machine having a respective ejection plate 410*a*, 410*b*, 410*c*. The ejection plates are staggered such that as each tool moves backwards, the ejector pins will touch the plate at different times, disengaging the respective closures from the tools at different times, and thereby allowing the closures formed to be ejected one after the other.

Each cap may be sterilised and/or disinfected after formation, such as by exposure to ultraviolet rays. Each cap may pass through an ultraviolet sterilisation and/or disinfection machine before being applied to a container.

Figure 9A:
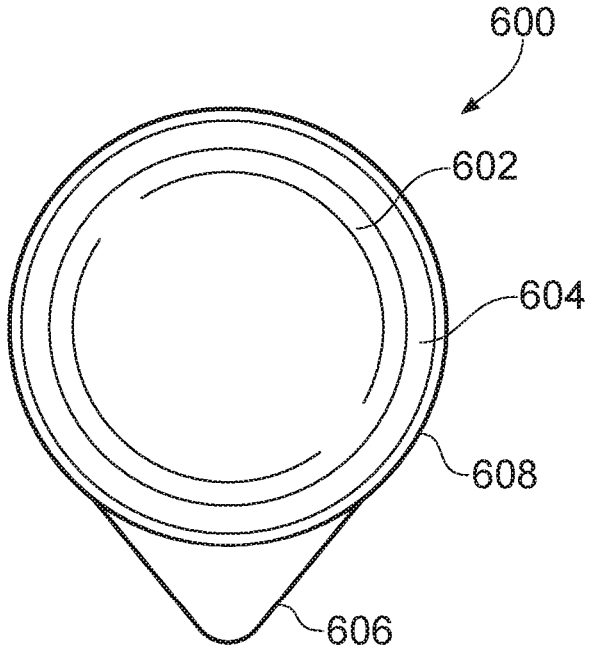
FIG. 9*a* shows a schematic plan view of a closure according to the present invention.
Figure 9B:
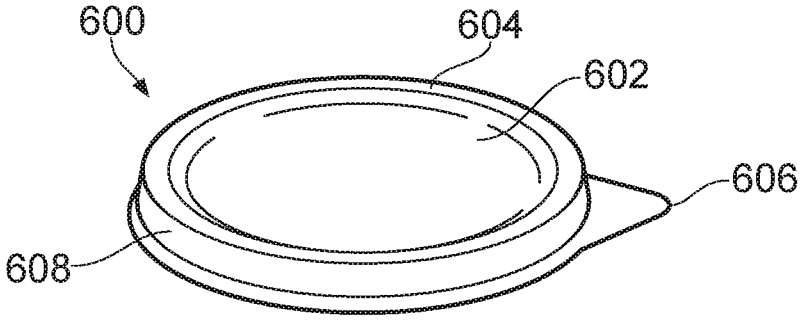
FIG. 9*b* shows a schematic isometric view of a closure according to the present invention.

FIG. 9*a* shows a plan view of a closure 600. The closure 600 may be a metallic cap formed of steel or aluminium and may comprise a plastic layer. The closure 600 comprises a top surface formed of a recess 602 and an annulus 604 surrounding the recess 602. The recess 602 and annulus 604 may each be planar and the annulus 604 may lie in a first plane, which is spaced from and parallel to a second plane, in which the recess 602 lies. Together, the recess 602 and annulus 604 form a top surface of the closure 600.

Extending downwardly from the top surface of the closure 600, i.e. extending downwardly from an outer diameter of the annulus 604 is a sidewall or skirt 608. It will be understood that the sidewall 608 may be substantially perpendicular to the top surface, or may have a frustoconical shape, so that the sidewall defines at a bottom edge, opposite the top surface, an opening having a diameter greater than or equal to the diameter of the annulus 604.

Figure 9C:
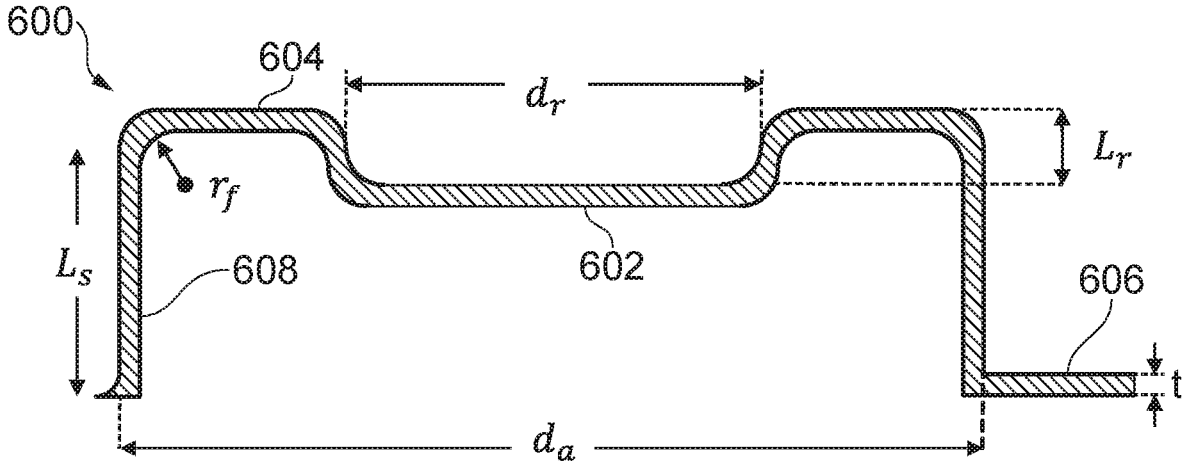
FIG. 9*c* shows a dimensioned cross-section of a closure according to the present invention.

FIG. 9*c* shows a cross-section of the closure 600, with relevant dimensions drawn thereon. While the closure is shown as having a significant thickness, it will be understood that the thickness of the material t may be small, such that the dimensions of the cap may be considered the same independently of whether the thickness of the material is accounted for. The thickness of the closure t may be less than 0.05 mm.

The depth of the recess, which may be measured from a top surface of the recess 602 to a top surface of the annulus 604 and may be designated $L_r$, and may be 1 mm or less, preferably 0.2 mm or less.

The recess 602 may have a diameter $d_r$, which may be 21 mm or more, and the annulus may have an outer diameter $d_a$ which may be 28 mm or less, optionally as small as 23.2 mm or less. The diameter of the annulus may be measured to an outer diameter of the top of the side wall 608, at which the sidewall becomes filleted. The annulus thickness may be defined as $d_a$ minus $d_r$ and may be 8.3 mm or less.

The sidewall 608 may be connected to the annulus 604 via a fillet having a radius $r_f$, which may be 0.1 mm or more, preferably 0.4 mm or more. At an end of the sidewall 608, opposite the annulus 604, the closure 600 may have a pull tab 606, which may take the form of a flange extending radially outwardly from the bottom end of the sidewall 608. The pull tab 606 may be flattened to a container when the closure 600 is sealed onto a container.

The closure 600 may further comprise a third portion, which may be radially inside the recess 602, and may lie in the first plane or in a third plane spaced from the first and second planes. In an example, the recess 602 may be annular and may take the form of an annular trench.

Although the annulus 604 and recess 602 may lie in two respective planes, it is not necessary that the annulus 604 and recess 602 are flat. The annulus 604 and recess 602 may be corrugated or may have relatively flat concave or convex shapes.

The closure 600 is shown here as being substantially circular, but it is not necessary that the closure 600 is circular. The closure 600 may have straight sides and corners or may be ovoid.

Figure 10:
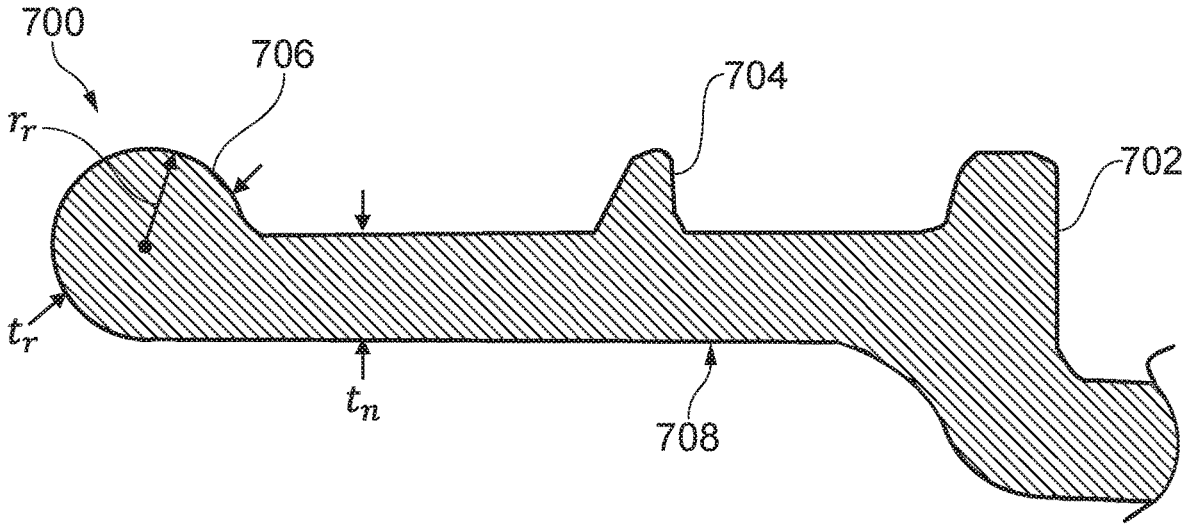
FIG. 10 shows a dimensioned cross-section of a neck of a container according to the present invention.

FIG. 10 shows a cross-section of a neck 708 of a preform 700 according to the invention. Notably, the neck 808 of a container 800 may be identical to a neck 708 of a preform 700 from which the container 800 is formed.

The preform 700 has a neck 708, comprising a rim 706 and at least one support flange 702, optionally two support flanges 702, 704. The rim 706 may have a substantially toroidal or "doughnut" shape, and the toroid may have a radius $r_r$, the radius $r_r$ being a radius of a perimeter of a cross-section of the toroid, the cross-section taken in a plane perpendicular to an opening 712. The toroid may have a thickness $t_r$, which may be twice the radius $r_r$ in the case that the toroid has a circular cross-section. While the toroid is shown as having a circular cross-section, it will be understood that it may have an elliptical, semi-circular or ovoid cross-section. A radially inner side of the toroid, defining an opening 712 of the preform 700, may have a substantially flat surface and may not be involved in the sealing of the container 800. The radius $r_r$ of the toroid may be 1 mm, or may be greater than 1 mm. The thickness $t_r$ of the rim 706 may be 2 mm or greater. The thickness $t_r$ of the rim may be greater than a thickness of the neck $t_n$, the thickness $t_n$ being measured at a portion of the neck 708 extending from the toroid 706, where the radially inner and radially outer surfaces of the neck 708 are substantially parallel. The thickness of the neck may be 1.1 mm.

Each radial support flange 702, 704 may have a flat surface, which may be annular, and may extend radially outward from the neck 708. The radial flanges 702, 704 may extend outwardly 1 mm from the neck 708. The radial flanges 702, 704 may be engaged by arms of a gripper during a filling of sealing of the container.

Figure 11:
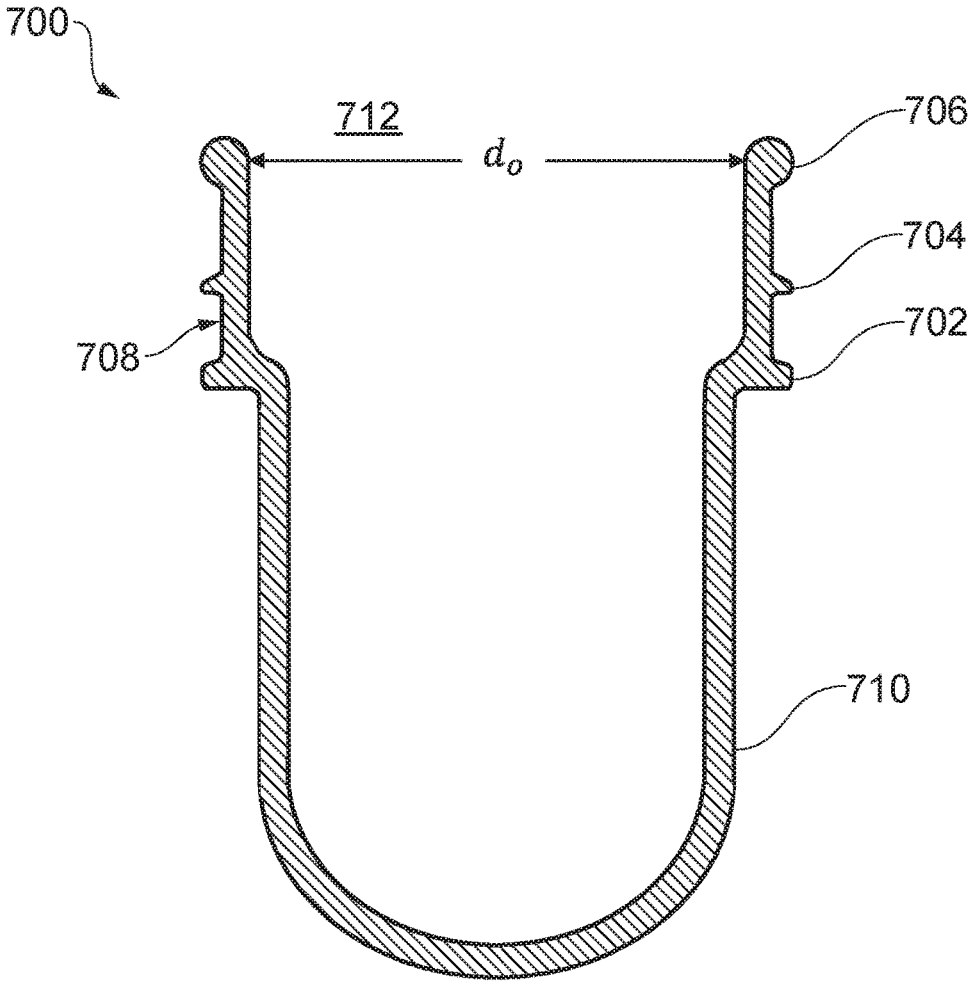
FIG. 11 shows a cross-section of a preform for forming a container according to the present invention.

A complete preform cross section is shown in FIG. 11. The preform 700 may further comprise a preform body 710. The preform body 710 may have a diameter less than a diameter of an opening of the preform, the diameter of the opening of the preform $d_o$ being defined by an inner surface of the rim 706. The preform body 710 may be substantially test-tube-shaped, and so may be substantially cylindrical with a domed bottom.

The preform 700 may be formed by injection moulding. A prefrom-shaped mould may be used and may contain a blowing stick. Molten plastic (such as PET) may then be injected into the mould so that the blowing stick is inside the preform and the plastic may harden to the shape of the mould.

Figure 12:
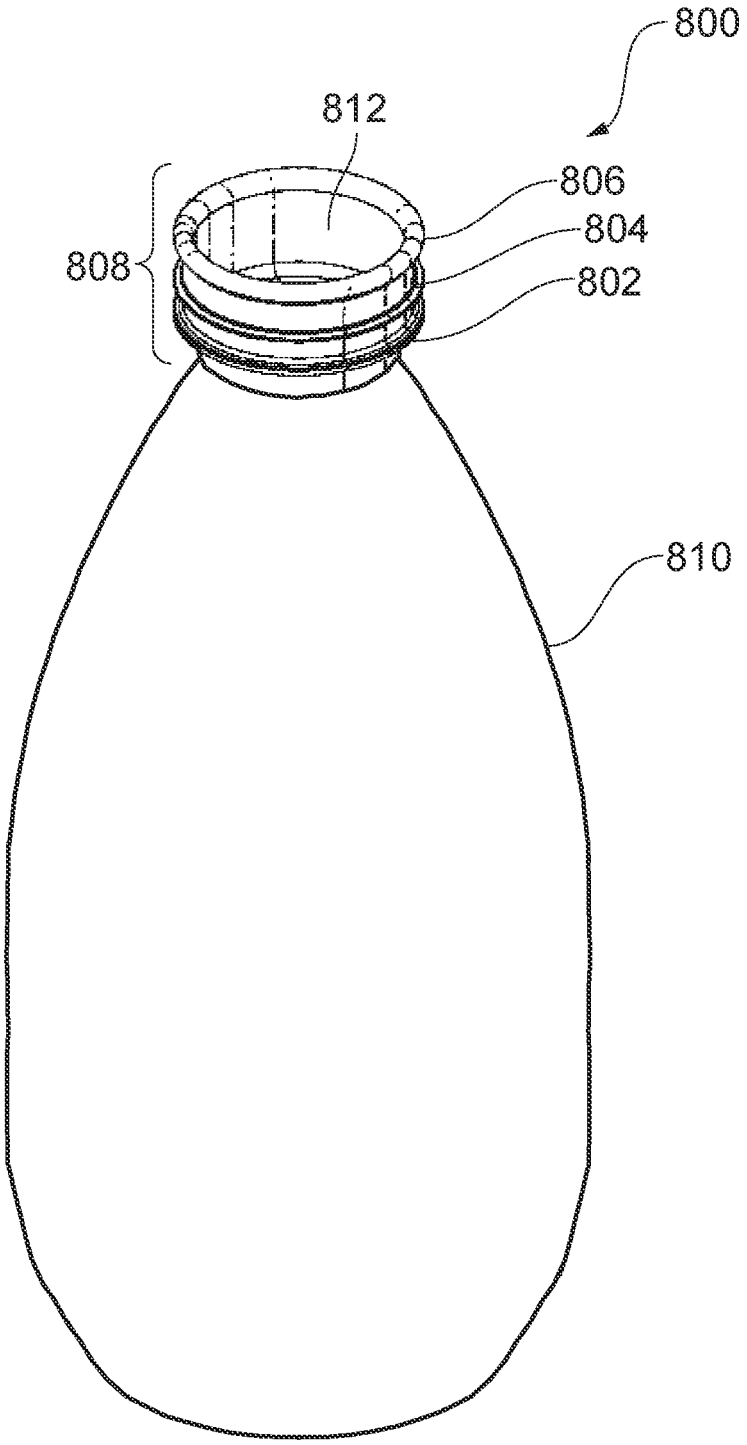
FIG. 12 shows a container according to the present invention.

The preform body 710 may be blow-mouldable, i.e. may be heated and may have air injected into it (e.g. via a blowing stick) so as to deform the preform body 710 in order to form a container body 810. By this method, a container 800 as shown in FIG. 12, having a container rim 806 and two container support flanges 802, 804 may be formed. The container body 810 may be transparent and water tight.

Figure 13:
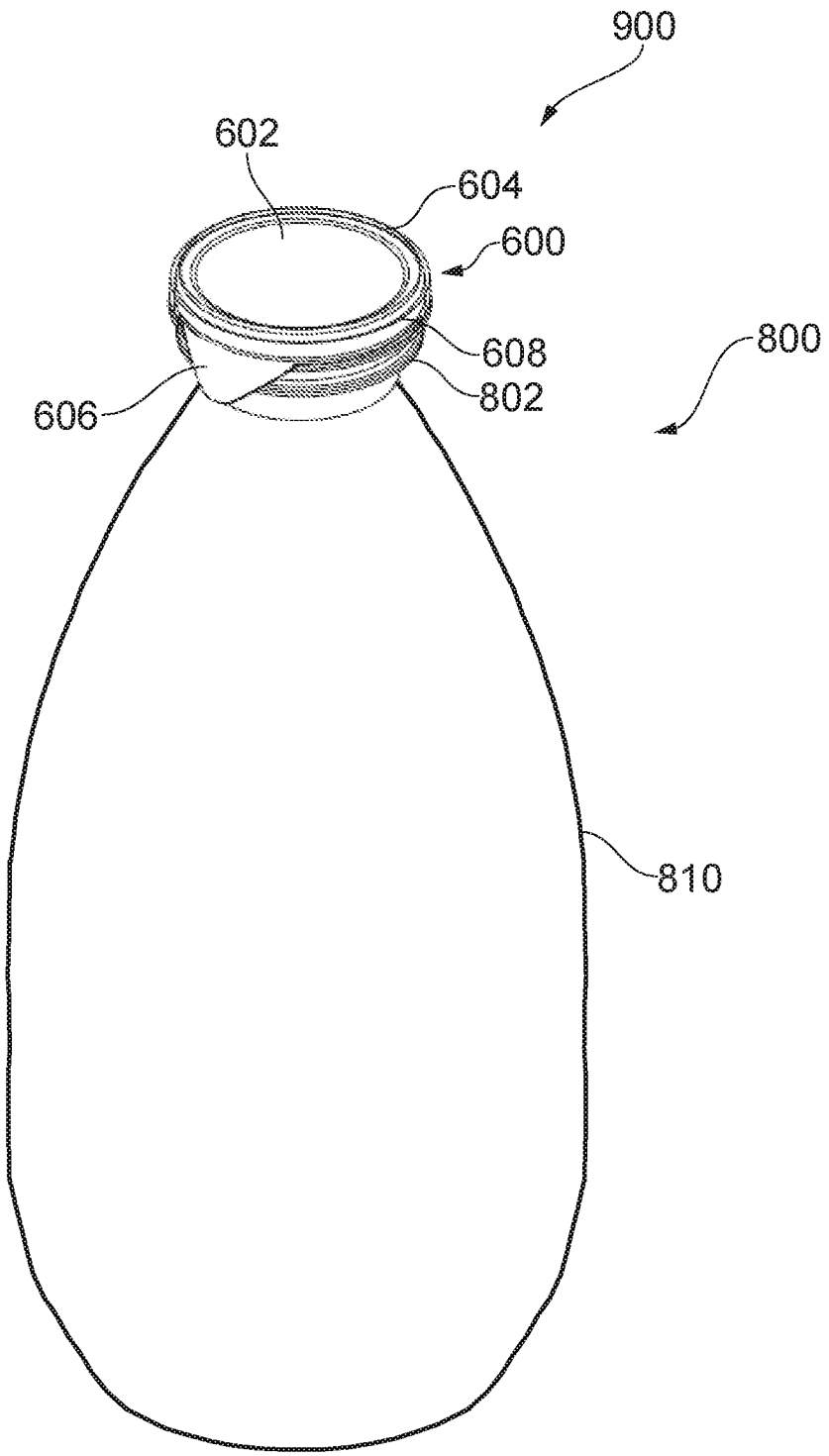
FIG. 13 shows a sealed container according to the present invention.

After sealing by a sealing machine, such as the machine 100 shown in FIG. 1, a sealed container 900 as shown in FIG. 13 may be formed. The sealed container 900 may comprise a closure 600, adhered to a container 800. The sealed container 900 may be formed so that the closure 600 is deformed so that the closure 600 is shaped and adhered to the rim 806.

Figure 14:
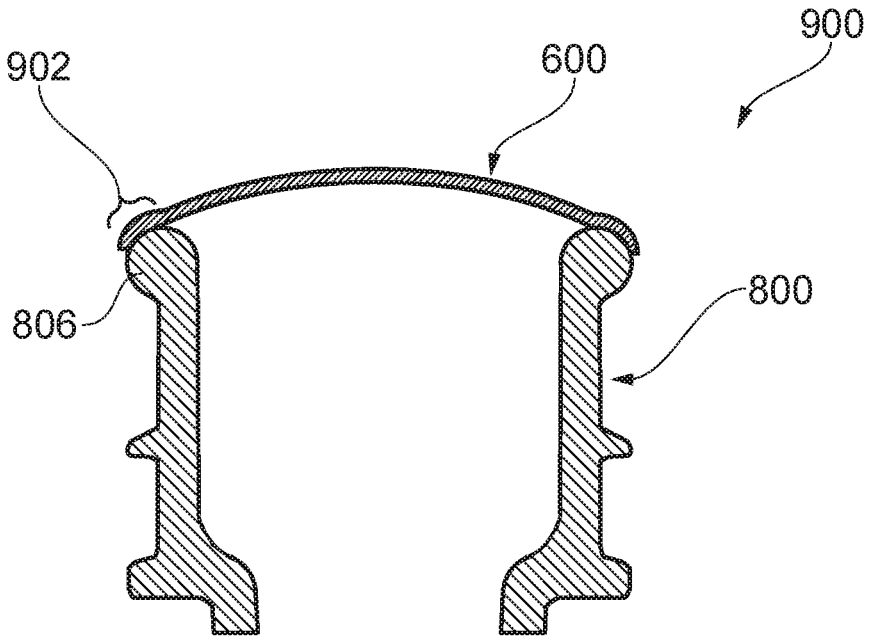
FIG. 14 shows a cross-section of the neck of a sealed container according to the present invention.

FIG. 14 shows a schematic cross-section of a sealed container 900 according to the present invention. In this cross-section, the closure 600 has an outwardly convex, domed shape and is adhered to the container 800 at an adhesive footprint 902. As shown in FIG. 14, the closure 600 meets the container 800 at a radially inner point of the adhesive footprint 902 where the container 600 is substantially tangential to the rim 806 of the container 800.

Since the thin material of the closure 600 will transmit substantially only tensile forces, the adhesive by which the closure 600 is adhered to the container 800 will suffer only shear forces, since the tensile forces within the closure will be aligned with the closure 600, which is tangential to the rim 806. Thereby, a high burst pressure may be obtained. The sealed container 900 may be opened by exerting a tensile force on the adhesive, using the pull tab 606 to pull the closure 600 away from the container 800.

FIG. 15 shows, for comparison, a prior art sealed container 1100. As shown in FIG. 15, a rim of a prior art sealed container 1104 has a substantially square cross-section and therefore a closure 1102, which has a domed outward shape due to an internal pressure of the container 1100, meets the container 1104 at an angle. The closure 1102 is adhered to the container 1104 at an adhesive footprint 1106. As the closure 1102 will have a tensile stress, which is not tangential to the rim of the container 1104, there will be a tensile force exerted on the adhesive connecting the closure 1102 to the container 1104 and therefore a failure of the adhesive is likely at a low internal pressure of the sealed container 1100.

Although the invention has been described above with reference to one or more preferred embodiments, it will be appreciated that various changes or modifications may be made without departing from the scope of the invention as defined in the appended claims.

The invention claimed is:

1. A machine for manufacturing a closure, comprising:

a workspace for receiving a blank;

a rim punch that is arranged to engage a blank received within the workspace;

a centre punch that i) has a solid circular surface that is arranged radially inside the rim punch, and ii) is arranged to engage the blank received within the workspace to form a closure, and to move, with the rim punch, during at least a portion of the manufacturing process; and an ejection pin that is arranged to engage and disengage an ejection plate during the manufacturing process in a manner in which engagement between the pin and the ejection plate while the ejection plate is stationary stops movement of the centre punch while the rim punch continues to move, thereby causing the closure to disengage from the rim punch.

2. The machine of claim 1, wherein the rim punch is arranged to move a longer distance than the centre punch.

3. The machine of claim 1, further comprising a fluid jet arranged to disengage a closure from the centre punch.

4. The machine of claim 1, wherein the rim punch and the centre punch are arranged to move in a first direction toward the workspace in order to engage the closure.

5. The machine of claim 1, wherein the ejection pin limits movement of the centre punch in a direction away from the workspace.

6. The machine of claim 1, wherein the ejection pin is arranged to engage the centre punch at a first end of the ejection pin and to engage the ejection plate at a second end of the ejection pin, opposite the first end.

7. The machine of claim 6, wherein the centre punch is arranged to remain stationary while the centre punch, ejection pin, and ejection plate are engaged with each other during ejection of the closure.

8. A system for manufacturing a closure, comprising the machine of claim 1, and wherein the system further comprises a second machine, the second machine comprising a second workspace that receives a second blank, a second rim punch that engages the second blank, a second centre punch that is arranged radially inside the second rim punch and also engages the second blank, and a second ejection pin that causes the second closure to disengages from the rim punch.

9. The system of claim 8, wherein the ejection pin and the second ejection pin have different lengths.

10. The system of claim 8, wherein:

the ejection plate and a second ejection plate that engages the second ejection pin each has a face that engages its respective ejection pin, and the respective faces are spaced apart from each other in a direction along which the rim punch and centre punch are arranged to move.

* * * * *